US010611522B2

(12) United States Patent
Rottman

(10) Patent No.: US 10,611,522 B2
(45) Date of Patent: Apr. 7, 2020

(54) DEVICE FOR THE COLLECTION, PRE-ANALYTIC TREATMENT, TRANSPORT AND GRINDING OF SOLID SAMPLES

(71) Applicant: ASSISTANCE PUBLIQUE—HOPITAUX DE PARIS, Paris (FR)

(72) Inventor: Martin Rottman, Paris (FR)

(73) Assignees: ASSISTANCE PUBLIQUE-HOPITAUX DE PARIS, Paris (FR); THE UNIVERSITY OF VERSAILLES SAINT-QUENTIN-EN-YVELINES, Versailles (FR)

( * ) Notice: Subject to any disclaimer, the term of this patent is extended or adjusted under 35 U.S.C. 154(b) by 1173 days.

(21) Appl. No.: 14/404,145

(22) PCT Filed: May 29, 2013

(86) PCT No.: PCT/IB2013/054423
§ 371 (c)(1),
(2) Date: Jan. 14, 2015

(87) PCT Pub. No.: WO2013/179232
PCT Pub. Date: Dec. 5, 2013

(65) Prior Publication Data

US 2015/0191276 A1 Jul. 9, 2015

(30) Foreign Application Priority Data

Jun. 1, 2012 (FR) ..... 12 55101

(51) Int. Cl.
*B65D 23/04* (2006.01)
*B01F 13/08* (2006.01)
(Continued)

(52) U.S. Cl.
CPC ..... *B65D 23/04* (2013.01); *B01F 11/0005* (2013.01); *B01F 13/0052* (2013.01);
(Continued)

(58) Field of Classification Search
CPC ..... B02C 17/06; B02C 17/005; B02C 17/04; B01F 7/00; B01F 11/0005; B01F 13/0052;
(Continued)

(56) References Cited

U.S. PATENT DOCUMENTS 3,894,692 A * 7/1975 Sanko ..... B02C 17/00 241/176
6,786,330 B2 * 9/2004 Mollstam ..... B65D 47/2031 206/219
(Continued)

FOREIGN PATENT DOCUMENTS

FR 2 943 900 10/2010
JP 63-256122 10/1988

*Primary Examiner* — Shelley M Self
*Assistant Examiner* — Smith Oberto Bapthelus
(74) *Attorney, Agent, or Firm* — Clark & Brody

(57) ABSTRACT

The invention relates to a device for the collection, pre-analytic treatment, transport and grinding of solid samples, comprising a flask (1) having an opening (11) closed by a removable stopper (2), for receiving a solid sample. Said flask contains a pre-analytic medium (4), a plurality of balls (3) consisting of a solid material, and a means for holding the balls in place, that is designed to lose its effect when the flask is mechanically shaken or closed by the stopper, in such a way that, when the flask is mechanically shaken, the impact of the balls causes the grinding of the solid sample and the mixing thereof with the pre-analytic medium.

6 Claims, 1 Drawing Sheet

(51) Int. Cl.

| | |
|---|---|
| ***B65D 51/28*** | (2006.01) |
| ***B02C 17/04*** | (2006.01) |
| ***B01F 13/00*** | (2006.01) |
| ***B01F 11/00*** | (2006.01) |
| ***B65D 81/32*** | (2006.01) |

(52) U.S. Cl.
CPC ..... *B01F 13/08* (2013.01); *B02C 17/04* (2013.01); *B65D 51/28* (2013.01); *B65D 51/2807* (2013.01); *B65D 81/3238* (2013.01); *B01F 2215/0037* (2013.01)

(58) Field of Classification Search
CPC ..... B01F 13/08; B01F 2215/0037; B65D 81/3238; B65D 51/28; B65D 51/2807
USPC ..... 241/172, 170, 184, 179; 366/343; 422/102
See application file for complete search history.

(56) References Cited

U.S. PATENT DOCUMENTS 6,814,319 B2 * 11/2004 Haskell ..... A61K 9/14 241/21
7,503,453 B2 * 3/2009 Cronin ..... B65D 47/243 206/221
2002/0118595 A1 * 8/2002 Miller ..... A61L 24/06 366/130
2002/0119200 A1 * 8/2002 Haskell ..... A61K 9/14 424/489
2004/0228208 A1 * 11/2004 Papania ..... B65D 51/2814 366/197
2009/0283018 A1 * 11/2009 Grasso, Jr. ..... B02C 17/22 106/709
2010/0025508 A1 * 2/2010 Didion ..... B02C 17/002 241/74
2010/0137567 A1 * 6/2010 Mertens ..... B02C 17/14 530/427
2010/0189604 A1 * 7/2010 Guasch ..... B01F 11/0002 422/430
2010/0202246 A1 * 8/2010 Huck ..... B01F 13/0052 366/185
2011/0054437 A1 * 3/2011 Perovitch ..... A61J 1/2093 604/411
2014/0034669 A1 * 2/2014 Frisch ..... B65D 23/04 222/80
2015/0191276 A1 * 7/2015 Rottman ..... B01F 13/0052 241/179

* cited by examiner

DEVICE FOR THE COLLECTION, PRE-ANALYTIC TREATMENT, TRANSPORT AND GRINDING OF SOLID SAMPLES

The invention relates to a device for the collection, pre-analytical treatment, transport and grinding of solid samples, with a view to a subsequent analysis, whether it is a biological, genetic, chemical or microbiological analysis or the extraction of nucleic acids, of proteins or of other organic or inorganic compounds.

This device can be used in many fields, such as in the medical, veterinary or environmental field, for the analysis of pollutants in particular.

In the medical field, many devices already exist for the collection of liquid samples, these devices then being placed directly in machines enabling their analysis.

Thus, in the case of blood samples for example, the latter are placed in sterile tubes. These tubes are usually under reduced pressure and can comprise, on their internal surface or in solution, a particular product chosen according to the subsequent analysis.

Mention may in particular be made of the tubes sold by the company Becton-Dickinson under the brand Vacutainer®.

In the case of liquid microbiological samples, sampling devices under reduced pressure containing a culture or transport medium are more widely used.

Mention may in particular be made of the blood culture flasks sold by the company Becton-Dickinson under the brand Bactec® or by the company bioMérieux under the brand Bact/Alert®, and the Wampole® Isostat®/Isolator™ microbial system tubes sold by the company Cardinal Health Systems.

Machines for analyzing liquid samples are widespread. Moreover, by virtue of the properties of the sampling tubes, the liquid samples do not, in most cases, require any handling prior to the analysis, other than an optional centrifugation step. They can therefore be analyzed very rapidly, without risk of degradation and without risk of error or contamination introduced by the handling or the opening of the sampling device.

However, it is sometimes necessary to analyze solid or heterogeneous samples, in particular in the context of the analysis of soil samples, or of the study of plants, or in the context of the analysis of solid tissues or of heterogeneous suspensions in human or veterinary medicine.

This is in particular the case for surgical operations and the diagnosis of infection on an implanted material, during the microbiological analysis carried out for the documentation or the diagnosis of infection. The problem is particularly sensitive in the context of the diagnosis of infections on an orthopedic material.

This is because infections on an orthopedic material and in particular on joint implants are difficult to diagnose because of the small amount of microorganisms present and of their metabolism adapted to survival in a biofilm at the surface of the implant or inside the cells present on the site of infection.

Moreover, the pathogens encountered are part of the skin flora and are indistinguishable from the usual contaminants encountered in clinical microbiology, such as *Staphylococcus* spp., *Corynebacterium* or *Propionibacterium*.

As a result, the diagnosis of these infections requires both maximum sensitivity and maximum specificity. The sensitivity is defined by the ratio of cases detected as positive/cases actually positive and the specificity by the ratio of cases detected as negative/cases actually negative.

To date, analyses of non-liquid samples are generally performed in the following way. Once the sample has been taken during an operation, percutaneously or by interventional radiology, it is placed in a sterile device (sampling flask) containing no solid or liquid adjuvant. It is, in certain cases, placed in a transport medium intended to ensure the survival of the microorganisms or the stability of the nucleic acids, proteins or any analyte, until the analysis is carried out. This solid, viscous, or heterogeneous specimen (bone, muscle, tendon, viscera, implanted material, or the like) is then sent to the laboratory. In the case of a solid sample, it is transferred in a device which enables the extraction of the microorganisms or of the genetic or protein material, in a liquid phase compatible with the biological analysis carried out downstream. The devices most commonly used are conventional mortars, ball mills (Retsch, Ultra Turrax, Precellys, MP FastPrep), blade mills (Stomacher) or sonicators (Bransonic, Bactosonic).

The performing of the grinding requires the addition of a liquid medium into which the analytes (microorganisms, nucleic acids, proteins or other organic or inorganic compounds) will be transferred because of the grinding.

The liquid medium is sampled after the grinding, as a liquid specimen would be, and introduced into the usual analysis chain (manual inoculation, automatic inoculation, chemical or biochemical analysis, gene amplification, immunoanalysis, chromatography, mass spectrometry or any other appropriate analysis method).

Thus, after having been placed in a sterile flask, the sample is removed therefrom so as to be transferred into the grinding device. The grinding medium is added if it is not already present in the grinding device, as are the grinding beads if they were not present in the grinding device or in the grinding medium. Only then can the grinding be carried out.

This preparation of the sample comprises several successive steps with repeated manipulations, and multiple processes and reagents, the traceability of which is difficult to establish. These successive steps can therefore result in degradation of the sample and, possibly, in the contamination thereof by analytes which were not present at the start in the sample.

Thus, the information given by the analyses is neither sufficiently specific nor sufficiently reliable.

In the case of the infection of joint prostheses for example, another technique exists. It consists in placing the prosthesis in an ultrasonic bath, so as to recover the biofilms formed by the organisms associated with the infection, which will then be analyzed.

Mention may be made of the article by Trampuz et al. "*Sonication of Removed Hip and Knee Prostheses for Diagnosis of Infection*", The New England Journal of Medicine, 16 Aug. 2007, and U.S. Pat. No. 8,076,117 which relates to processes for removing biological films.

This technique remains complex to implement. Moreover, it does not make it possible to perform analyses before the operation to implant the material or when the prosthesis remains in place after debridement.

Finally, a single sample can be analyzed and it may be contaminated. This reduces the reliability of the analysis.

It is, moreover, for this reason that, during an operation, 5 samples are generally taken, so as to be able to cross reference the results. The number of analyses to be carried out is therefore considerable.

Solutions have already been proposed for increasing the reliability of analyses.

Thus, it has already been proposed to add balls and a sterile liquid to a specimen flask after introduction of a sample. The whole thing is then agitated manually or in a machine, so as to grind and homogenize the sample by impact and friction.

For manual agitation, mention may be made of the article by Atkins et al., "*Prospective Evaluation of Criteria for Microbiological Diagnosis of Prosthetic-Joint Infection at Revision Arthroplasty*" Journal of Clinical Microbiology, October 1998, p. 2932-2939.

For mechanical agitation, mention may be made of Roux, A. L.; Sivadon-Tardy, V.; Bauer, T.; Lortat-Jacob, A.; Herrmann, J. L.; Gaillard, J. L. & Rottman, M. "*Diagnosis of prosthetic joint infection by beadmill processing of a periprosthetic specimen*", Clinical Microbiology and Infection, Vol. 17, No. 3, (March 2011), pp. 447-450, ISSN 1469-0691.

Some laboratories use devices comprising a container with a blade which mobilizes the grinding balls without agitating the flask (for example sold under the name Ultra-Turrax).

These devices make it possible to mechanize the grinding operation which is normally carried out in a mortar, but they sort out neither the problems of degradation of the analytes before the analysis, nor the contamination of the sample during the successive steps which are carried out, nor the difficult traceability of the various additives introduced.

The problems of loss of specificity through the contamination of the sample and loss of sensitivity through the depletion of the sample are still present.

The object of the invention is to overcome these drawbacks by providing a device for the collection, pre-analytical treatment, transport and grinding of solid samples, which makes it possible to limit as much as possible the manipulations of the sample between the taking thereof and the analysis thereof in liquid form using an appropriate method and to provide traceability of the specimens.

Thus, the invention relates to a device for the collection, pre-analytical treatment, transport and grinding of solid samples, comprising a flask having an opening closed by a removable stopper, for receiving a solid sample and in which are present a pre-analytical medium, a plurality of balls made of a solid material, and a means for holding the balls in place, that is designed to become ineffective when the flask is mechanically agitated or closed by the stopper, such that, when the flask is mechanically agitated, the impact of the balls causes the grinding of the solid sample and the mixing thereof with the pre-analytical medium.

This means for holding in place makes it possible to prevent the balls from escaping from the flask when the sample is introduced therein and before the flask is closed again and therefore to be certain that the appropriate number of balls is present during the agitation.

This is particularly important when the device is used in an operating block, since it prevents any risk of the balls escaping and entering the patient's body or being lost to the detriment of the effectiveness of the grinding.

The simplest pre-analytical medium will be sterile purified water intended to osmotically lyse eukaryotic cells. It may also be a microbiological transport medium of the Amies type, a cell culture medium for searching for viruses, a lysis or nucleic acid stabilization buffer (for example, in the case of ribonucleic acids, the RNAlater sold by the company Qiagen) or a buffer for protein analysis.

In order to promote the stability of the device, some pre-analytical media are composed of a plurality of solid and/or liquid components which must be reconstituted only at the time of use of the device in order to retain their properties. Thus, in some cases, at least one part of the pre-analytical medium is isolated from the rest of the flask by a means for holding in place, designed so as to become ineffective when the flask is mechanically agitated or closed by the stopper. These multi-component pre-analytical media will then be reconstituted by mixing the various components at the time of closure of the device by screwing in the stopper or at the time of grinding by agitation. It is also possible to provide for a component which is retained in the flask until the flask is opened by unscrewing the stopper, after the grinding operation.

The means for holding the balls and the components of the pre-analytical medium in place may be common or independent.

When the device is used for a microbiological analysis, it must be sterile. The sterility of the device is then provided by chemical or physical sterilization of the components of the device before or after assembly thereof.

Thus, in the context of microbiological diagnosis, this device is in the form of an entirely sterile kit, by virtue of which the only human intervention consists in opening the flask so as to introduce the sample therein and then closing the flask. The flask is then mechanically agitated and a sample is then introduced into the analytical chain as an initially liquid sample would be.

This device therefore prevents contamination or depletion of the sample, between the introduction thereof into the flask and the analysis thereof.

This makes it possible to analyze solid samples even more reliably, even more so since the traceability of the samples is easily ensured by labeling the flask.

This proves to be particularly important in the case of analyses carried out during operations of orthopedic nature.

In a first implementation variant of the means for holding in place, the balls are made of paramagnetic material and the means for holding in place comprises a removable magnet.

In a second implementation variant, the means for holding in place comprises a gel.

In a third implementation variant, the means for holding in place is made of a tearable or breakable material.

In this case, in a first embodiment, the means for holding in place is a membrane attached in the stopper of the flask, so as to make a housing for the plurality of balls.

In a second embodiment, the means for holding in place is a pouch containing the plurality of balls.

In the latter case, the pouch may also contain at least one part of the pre-analytical medium, the constituent material of the membrane then being impermeable to liquids.

In one implementation variant, the various means for holding the balls and the components of the pre-analytical medium in place may be combined. They may be common or independent of one another.

The pre-analytical medium is preferably in the form of a liquid or of a gel.

Finally, the device according to the invention is advantageously disposable, in particular when it is used in the medical field.

The invention will be understood more clearly and other aims, characteristics and advantages thereof will emerge more clearly on reading the following description of implementation examples, which is given from the viewpoint of the appended drawings on which:

The elements common to the various figures will be denoted by the same references.

Figure 1:
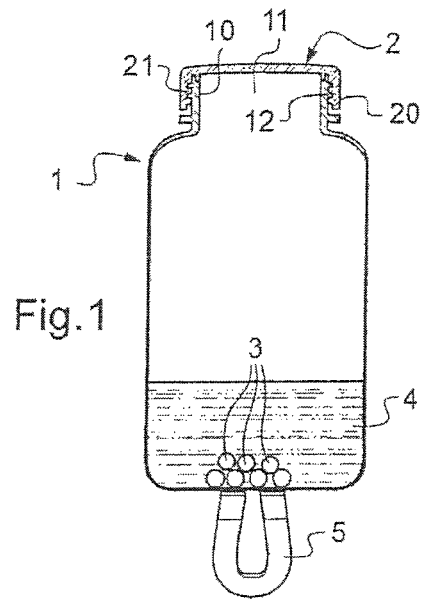
FIG. 1 is a sectional view of a device according to the invention.

FIG. 1 shows a flask 1, the opening 11 of which is closed by a stopper 2.

In the example shown in FIG. 1, the neck 10 of the flask comprises a thread 12 which engages with a thread 21 provided on the skirt 20 of the stopper.

Balls 3 and also a pre-analytical medium 4, in this case in liquid form, are placed inside the flask 1. These balls can be made of glass or metal.

The flask, like the balls and the transport medium, are sterile.

FIG. 1 shows a magnet 5 which is in this case provided on the bottom of the flask. This magnet is not systematically provided. In the case where the balls 3 are made of a paramagnetic material, the magnet makes it possible to immobilize the balls against the wall of the flask, in the vicinity of the magnet. The balls can in particular be made of AISI 404 stainless steel.

The device according to the invention is used in the following way, for example in an operating block.

During an operation, a person opens the flask, deposits a solid specimen therein and then closes it again.

The flask can then be agitated manually. It can also be placed in an appropriate machine.

Mention may in particular be made of the machine sold under the name Mixer Mill MM® by the company Retsch.

Because of the presence of the balls made of solid material in the flask, the agitation caused by this machine makes it possible to obtain the suspension of an appropriate part of the sample by impact and friction.

A sample of the suspension is then taken from the flask for the purpose of analyzing it in conventional machines for the analysis of liquid samples.

When the magnet 5 is provided on the flask 1, it is removed therefrom before the flask is agitated so as to render the balls entirely effective.

The pre-analytical medium could also be in the form of a gel, so as to retain the balls in the flask before it is agitated, the gel becoming liquid after agitation. For example, a gel of agarose at low concentration (0.3% for example) meets these requirements.

In this case, the presence of a magnet is not required in order to retain the balls.

Figure 2:
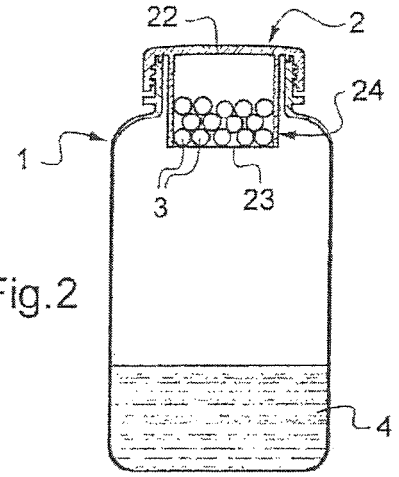
FIG. 2 is a sectional view of an implementation variant of the device according to the invention.

FIG. 2 shows an implementation variant in which the balls 3 are placed in a housing 24 attached to the upper part 22 of the stopper 2.

This housing is closed by a membrane 23 made of a tearable material, for example a thin film of polystyrene or of another appropriate polymer.

Moreover, the flask 1 still comprises a pre-analytical medium 4.

In this variant, the device is used as previously. When it is subjected to manual agitation or agitation caused by a machine, the membrane 23 breaks and the balls 3 can perform their grinding function.

In one variant (not shown), the means for holding the balls in place may be a housing formed in the stopper which opens when it is screwed onto the neck 10 of the flask. For example, a seal may be torn by the screwing of the stopper, or a second stopper with an inverted thread may open the housing during the screwing of the stopper.

Figure 3:
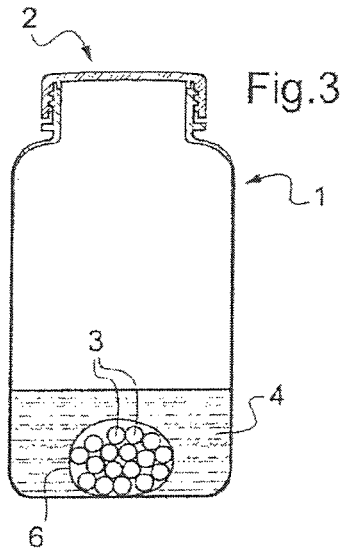
FIG. 3 is a sectional view representing another variant of the device according to the invention.

FIG. 3 shows a variant of the device, in which the balls 3 are placed inside a pouch 6, itself made of a tearable material, for example a thin film of polystyrene or of another appropriate polymer.

This pouch is in this case placed in the pre-analytical medium 4. It should therefore be made of a material impermeable to liquids. Other solutions could be envisioned, for example the attachment of the pouch 6 to the stopper 2.

Here again the device is used as previously. When it is subjected to agitation, the pouch 6 breaks and the balls are mixed with the specimen and the pre-analytical medium 4. They can thus perform their grinding function.

Figure 4:
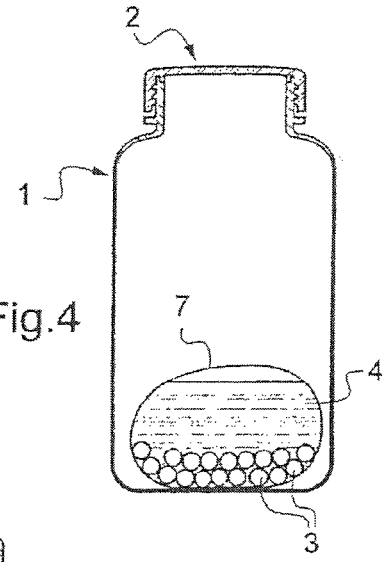
FIG. 4 is a sectional view representing a variant of the device shown in FIG. 3.

FIG. 4 shows another implementation variant in which both the pre-analytical medium 4 and the balls 3 are placed inside a pouch 7.

The pouch 7 is made of a tearable material impermeable to liquids, for example a thin film of polystyrene or of another appropriate polymer.

The device is used as previously. When it is subjected to agitation, the pouch 7 breaks so as to release both the pre-analytical medium 4 and the balls 3. The latter can thus perform their grinding function.

In one implementation variant (not shown), the pre-analytical medium and the balls are placed in the bottom of the flask and they are separated from the rest of the flask by a paraffin seal or a seal made of a breakable polymer.

This seal makes it possible to separate the pre-analytical medium and the balls from the specimen, until grinding.

Moreover, in the implementation examples shown in FIGS. 1, 2 and 3, the pre-analytical medium 4 is directly poured into the flask.

However, pre-analytical media activated by mixing several active components stored separately can be envisioned. This is in particular the case for components of which the long-term stability requires the separation of two or more liquid components, or the separation of one or more solid components and one or more liquid components. These components can, for example, be provided for in housings closed by seals which are tearable or breakable by the balls during agitation or by the screwing of the stopper after introduction of the specimen.

One of the components may also be provided for in a housing in which it will be held until the opening of the flask and therefore once the grinding operation is finished.

The means for holding the components of the pre-analytical medium in place can be combined with the other means for holding the balls in place. Thus, by way of example and without limiting the possible combinations, a gel or a magnet holding the balls in place can be combined with a tearable seal retaining a liquid and/or with one containing a powder.

Figure 5:
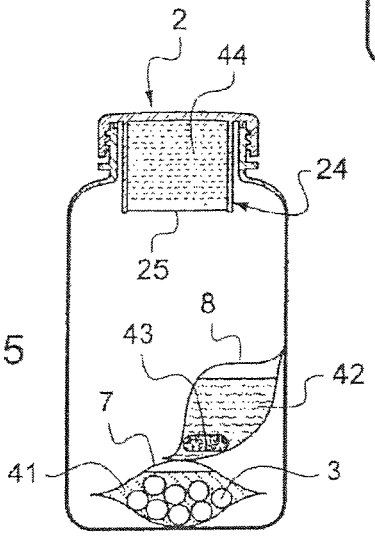
FIG. 5 is a sectional view representing a variant of the device shown in FIG. 4.

Thus, FIG. 5 shows a variant of the embodiment according to FIG. 4. In this variant, only one component 41 of the pre-analytical medium is provided for in the pouch 7, which also contains balls 3.

Another pouch 8 contains two other components 42 and 43 of the pre-analytical medium.

The component 42 is in liquid form and the pouch 8 is therefore leaktight. It can be made of a tearable polymer film. The latter can be designed so as to release a grinding additive.

The component 43 is in solid form (powdered tablet, for example).

Finally, a component 44 of the pre-analytical medium can be provided for in a housing 24 provided for in the stopper 2 which is closed by a tearable seal 25. The latter opens when the flask is agitated (see FIG. 2) or under the effect of the screwing of the stopper.

Thus, in any event, the device according to the invention makes it possible to limit the human interventions between the taking of the solid sample and the subsequent analysis. It therefore makes it possible to increase the reliability of the analysis and the traceability of the analytical process.

When it is used in the medical field, the device is preferably disposable.

Moreover, when the device is intended for a microbiological diagnosis, all these components are sterile.

The reference signs inserted after the technical characteristics which appear in the claims have the sole purpose of facilitating the understanding of the latter and could not limit the scope thereof.

The invention claimed is:

1. A device for the collection, pre-analytical treatment, transport and grinding of solid samples, comprising a flask (1) having an opening (11) closed by a removable stopper (2), for receiving a solid sample and in which are present a pre-analytical medium (4) and a plurality of balls (3) made of a solid material, wherein the pre-analytical medium (4) comprises at least a first compound in gel holding the balls in place and being designed so as to liquefy and release the balls when the gel is disrupted, such that, when the flask is mechanically agitated, the impact of the balls causes the grinding of the solid sample and the mixing thereof with the pre-analytical medium, and wherein the first compound in gel holding the balls in place is located at the bottom of the flask.

2. The device as claimed in claim 1, wherein the pre-analytical medium (4) comprises a second compound isolated from the rest of the flask by a means for holding in place designed so as to break and release the second compound when the flask is mechanically agitated or when the removable stopper is screwed or unscrewed.

3. The device as claimed in claim 2, wherein the means for holding the second compound of the pre-analytical medium (4) is made of a tearable or breakable material.

4. The device as claimed in claim 3, wherein the means for holding the second compound of the pre-analytical medium (4) comprises a seal closing the removable stopper (2) so as to provide a housing (24) for said second compound of the pre-analytical medium (4).

5. The device as claimed in claim 3, wherein the means for holding the second compound of the pre-analytical medium (4) comprises a pouch (8) containing said second compound of the pre-analytical medium (4).

6. The device as claimed in claim 1, further comprising a breakable pouch containing the first compound of the pre-analytical medium (4).

* * * * *